US009752256B2

(12) United States Patent
Afshari et al.

(10) Patent No.: US 9,752,256 B2
(45) Date of Patent: Sep. 5, 2017

(54) PROCESS FOR MAKING A YARN HAVING IMPROVED STRENGTH RETENTION AND YARN MADE THEREBY

(71) Applicant: E I DU PONT DE NEMOURS AND COMPANY, Wilmington, DE (US)

(72) Inventors: Mehdi Afshari, Midlothian, VA (US); Walter Randall Hall, III, Richmond, VA (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 257 days.

(21) Appl. No.: 14/804,439

(22) Filed: Jul. 21, 2015

(65) Prior Publication Data

US 2016/0032492 A1 Feb. 4, 2016

Related U.S. Application Data

(60) Provisional application No. 62/031,304, filed on Jul. 31, 2014.

(51) Int. Cl.

| | |
|---|---|
| ***D01D 5/06*** | (2006.01) |
| ***D01D 10/02*** | (2006.01) |
| ***D02G 3/02*** | (2006.01) |
| ***D01F 6/60*** | (2006.01) |
| ***D01D 10/06*** | (2006.01) |

(52) U.S. Cl.

CPC ..... *D01D 5/06* (2013.01); *D01D 10/02* (2013.01); *D01D 10/06* (2013.01); *D01F 6/605* (2013.01); *D02G 3/02* (2013.01); *D10B 2331/021* (2013.01)

(58) Field of Classification Search

CPC ..... D01F 6/605; D01D 5/16; D01D 10/02; D01D 10/06; D02G 3/02; D02G 3/44; D02G 3/446; D02G 3/447; D02G 3/45; B29C 27/8895; D10B 331/021

USPC ..... 264/172.16; 428/395; 442/215

See application file for complete search history.

(56) References Cited

U.S. PATENT DOCUMENTS

| | | | |
|---|---|---|---|
| 3,063,966 | A | 11/1962 | Kwolek et al. |
| 3,767,756 | A | 10/1973 | Blades |
| 3,869,429 | A | 3/1975 | Blades |
| 3,869,430 | A | 3/1975 | Blades |
| 4,320,081 | A | 3/1982 | Lammers |
| 4,374,978 | A | 2/1983 | Fujiwara et al. |
| 4,440,710 | A | 4/1984 | Fujiwara et al. |
| 4,726,922 | A | 2/1988 | Cochran et al. |
| 4,859,393 | A | 8/1989 | Yang et al. |
| 4,898,704 | A | 2/1990 | Luckey |
| 4,902,774 | A | 2/1990 | Yang et al. |
| 4,971,539 | A | 11/1990 | Luckey |
| 5,173,236 | A | 12/1992 | Yang |
| 5,182,067 | A | 1/1993 | Chiou |

(Continued)

*Primary Examiner* — Frank Vineis

(57) ABSTRACT

The invention relates to a continuous process for making a yarn comprising filaments of poly (paraphenylene terephthalamide) and the yarn made thereby, the process utilizing a coagulation bath having a temperature of at least 20° C., washing with an aqueous liquid, and drying the filaments under a tension of 0.3 to 1.0 grams per denier wherein the filaments are dried for 0.4 to 0.9 seconds at a temperature of from 250 to 325° C. The yarn has a tenacity of at least 22 gpd, an elongation at break of at least 3.2 percent, and a tensile modulus of from 530 to 700 gpd; the yarn further has a heat-aged strength retention (HASR) of at least 93 percent and the filaments in the yarn have a D110 crystallinity of at least 55 angstroms.

15 Claims, 1 Drawing Sheet

(56) References Cited

U.S. PATENT DOCUMENTS

| | | | |
|---|---|---|---|
| 5,302,451 | A | 4/1994 | Chiou |
| 7,976,943 | B2 | 7/2011 | Chitrangad |

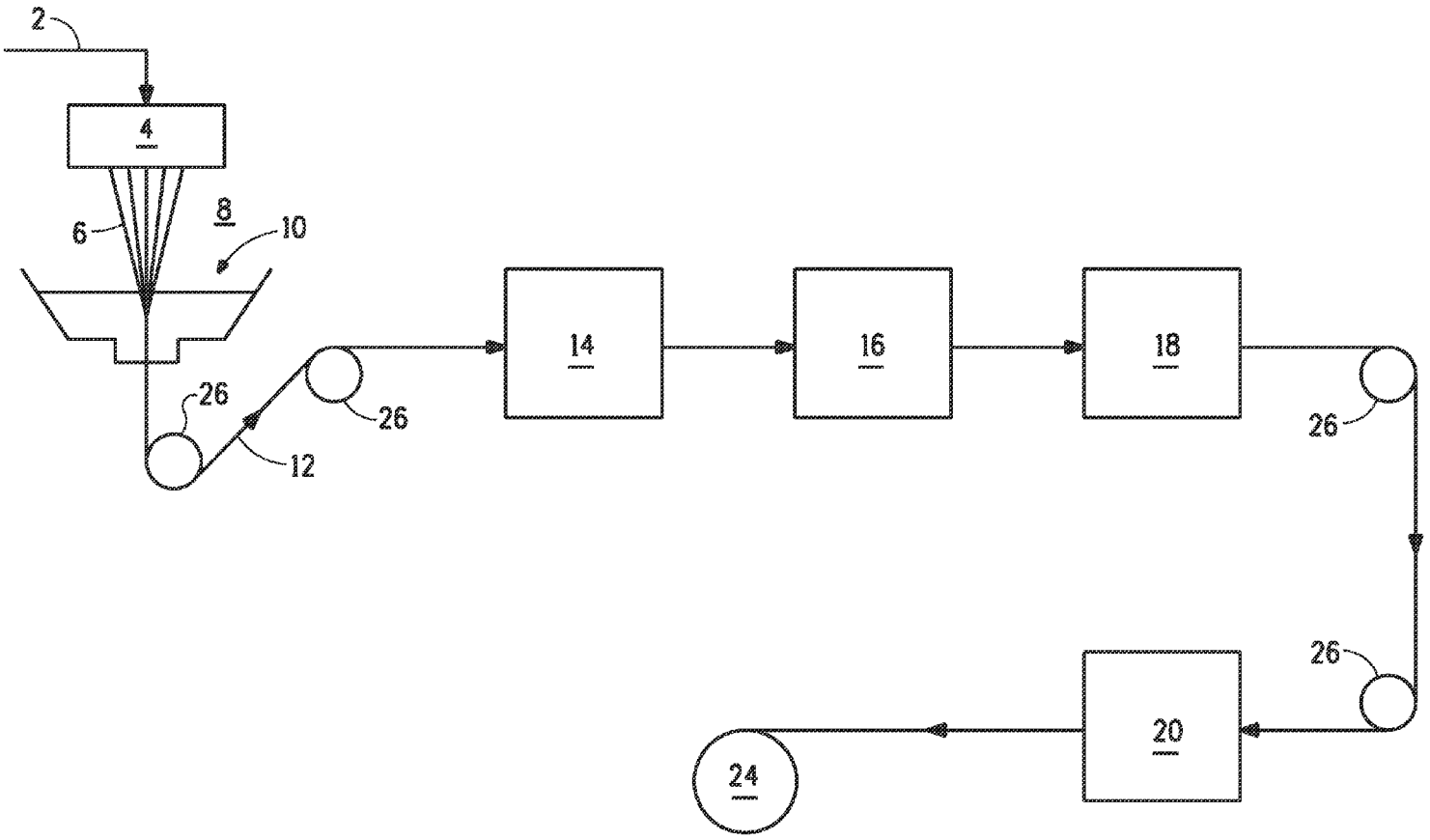
2
4
6
8
10
12
14
16
18
20
24
26
26
26
26

PROCESS FOR MAKING A YARN HAVING IMPROVED STRENGTH RETENTION AND YARN MADE THEREBY

BACKGROUND OF INVENTION

This invention relates to fibers and yarns made from poly (paraphenylene terephthalamide) (PPD-T) that exhibit high initial strength and retain a high percentage of that high strength after a timed exposure to certain high temperatures. These fibers and yarns are useful in fiber applications wherein the fibers and/or yarns are exposed to high temperatures during later processing, such as in tire manufacture. For example, it is important that any cords that include such fibers and/or yarns do not lose substantial strength during exposure to high temperatures during rubber curing steps.

U.S. Pat. Nos. 5,182, 067 & 5,302,451 to Chiou discloses as-spun fiber having 0.5 to 3.0 percent sulfur as bound sulfonic acid or sulfonate groups. The fiber and has an as-spun yarn tenacity greater than 20 grams per denier, heat-aged strength retention of greater than 90 percent, and dipped cord strength greater than 18 gram per denier. The process for making the fiber includes PPD-T polymer sulfonation by exposure to highly concentrated sulfuric acid in dope preparation under carefully controlled temperature and time.

U.S. Pat. Nos. 3,767,756; 3,869,429; & 3,869,430 to Blades disclose fibers of at least about 18 gpd consisting essentially of certain polyamides. U.S. Pat. No. 3,767,756 discloses heat treatment of the as-spun fibers, preferably in an inert atmosphere, to provide filaments having a much higher modulus but lower breaking elongation. U.S. Pat. Nos. 3,869,430 & 3,869,429 describe a heat treatment process for as-spun PPD-T filaments such as those prepared according to the process of U.S. Pat. No. 3,767,756 whereby the filaments are heated under a tension of at least 0.5 gpd (0.45 g/dtex) but less than the tension required to draw the filaments more than 1.03 times their initial length. The preferred temperature of the heating zone is 250-600° C., most preferably 450-580° C. These products have filament elongations of at least 3.5 percent and possess a novel crystalline structure with crystalline regions having a primary apparent crystallite size of less than 52 Angstrom units.

U.S. Pat. Nos. 4,374,978 & 4,440,710 to Fujiwara et al. disclose a high Young's modulus PPD-T fiber made by washing and drying fibers in the absence of substantial tension and heating the fibers under tension. Fujiwara et al. discloses the fibers of U.S. Pat. Nos. 4,374,978 & 4,440,710 have a larger orientation angle (OA) than fibers disclosed in the previously mentioned U.S. Pat. No. 3,869,430, etc. to Blades, and this relatively large orientation angle is closely related to the manufacturing process wherein all the steps from washing to drying are carried out in the absence of tension and the heat treatment is conducted under tension.

U.S. Pat. Nos. 4,859,393 & 4,902,774 disclose a PPD-T yarn having an apparent crystallite size in the range of 40 to 50 A, an orientation angle in the range of 20° to 30°, an elongation in the range of 4.5 to 5.6 percent, a tenacity of at least 18 grams per denier, and a modulus of at least 200 grams per denier and less than 450 grams per denier. These patents further disclose a process wherein a polymer is spun through an air gap into a coagulating bath at a temperature of at least about 20° C., but not greater than 40° C., and removed from the bath, the improvement consisting of washing the yarn and neutralizing the acid therein while the fiber is under a tension in the range of 0.2 to 0.4 grams per denier and then drying the yarn at a temperature below 200° C. under a tension in the range of from 0.05 to 0.2 grams per denier.

U.S. Pat. No. 5,173,236 to Yang discloses a process for making PPD-T fiber having increased tenacity and elongation at break obtained by the following combination of steps: a) extruding the anisotropic spinning dope through a capillary having a diameter of less than 64 micrometers (2.5 mils); b) maintaining the coagulation bath at a temperature of less than 10° C.; and c) washing and drying the coagulated fiber at controlled, substantially constant, tensions of 0.05 to 0.35 gpd, preferably 0.05 to 0.25 gpd. All of the aforementioned combination of steps must be used in order to realize the improvement of this invention.

U.S. Pat No. 4,726,922 to Cochran & Yang disclose a process for obtaining PPD-T filaments having improved tenacity by drying the filaments at a temperature of less than 300° C. under a tension of at least 2 gpd and thereafter discontinuing the drying under tension while the filaments on heated rolls have a moisture content of at least 8 percent.

U.S. Pat. No. 4,320,081 to Lammers discloses a process for the manufacture of fibers wherein the coagulation bath temperature is generally in the range of −10° to 50° C., and preferably between 0 and 25° C. The examples of this patent further disclose drying the fibers at temperatures of 120° and 140° C.

In many industrial applications, there is a need for fibers that exhibit a high strength when new, while at the same time retaining a high strength after exposure to certain extreme conditions, which can include elevated thermal conditions (high temperatures). In applications such as in tire walls, hoses, or belting, etc., one of the most important fiber strength qualities is the measured yarn strength retained after the cords containing those yarns are incorporated into the various finished elastomeric articles. In some instances, the yarns are formed into cords that are subsequently processed into dipped cords. In many instances, these are cords made from yarns that been coated with polymeric materials designed to increase adhesion of the yarn and/or cord to matrices such as rubber. Useful fibers retain a high strength after exposure to high temperatures during processing of the yarns into dipped cords, and/or further processing of yarns and/or cords into the finished elastomeric product, which can include exposure to high elastomeric and/or rubber curing temperatures.

Therefore, one key measured value for such yarns prior to being dipped is the property of "strength retention", specifically "heat-aged strength retention" (HASR). It is believed that the apparent crystallite size (ACS) is one important property related to improving HASR. Unfortunately, prior processes that teach methods for increasing the ACS in the fiber also result in increased yarn tensile modulus along with decreased yarn tenacity. Further, a yarn having increased tensile modulus is undesirable in some applications because it is believed the increased stiffness of the yarn contributes to increased compression fatigue.

Therefore what is needed is a process for making a new PPD-T yarn, and the yarn made thereby, the yarn having increased crystallinity as measured by apparent crystallite size (ACS) but also having the other favorable attributes desired in the yarn, such as high tenacity, moderate to lower modulus, and high elongation at break.

BRIEF SUMMARY OF THE INVENTION

This invention relates to a process for producing a yarn comprising filaments of poly (paraphenylene terephthalamide), the yarn having a HASR of at least 93 percent and the filaments in the yarn having an apparent crystallite size of from 55 to 80 angstroms, comprising the steps of:

i) in a continuous process, spinning a polymer dope through a spinneret having a plurality of orifices and coagulating the dope into a plurality of filaments in an aqueous coagulation bath having a temperature of at least 20° C.;

ii) washing with an aqueous liquid; and iii) drying the filaments under a tension of 0.3 to 1.0 grams per denier; wherein the filaments are dried for 0.4 to 0.9 seconds at a temperature of from 250 to 325° C.

This invention also relates to a yarn comprising filaments of poly (paraphenylene terephthalamide) and having a yarn tenacity of at least 22 gpd, an elongation at break of at least 3.2 percent, and a tensile modulus of from 530 to 700 gpd; the yarn having a HASR of at least 93 percent; and the filaments in the yarn having an apparent crystallite size of from 55 to 80 angstroms.

This invention further relates to a dipped cord comprising a yarn comprising filaments of poly (paraphenylene terephthalamide) and having a yarn tenacity of at least 22 gpd, an elongation at break of at least 3.2 percent, and a tensile modulus of from 530 to 700 gpd; the yarn having a heat-aged strength retention (HASR) of at least 93 percent; and the filaments in the having an apparent crystallite size of from 55 to 80 angstroms.

DETAILED DESCRIPTION OF THE INVENTION

This invention relates to a process for producing a yarn comprising filaments of poly (paraphenylene terephthalamide), the yarn having a HASR of at least 93 percent and the filaments in the yarn having an apparent crystallite size of from 55 to 80. The process is a continuous process includes the steps of spinning a polymer dope through a spinneret having a plurality of orifices and coagulating the dope into a plurality of filaments in an aqueous coagulation bath having a temperature of at least 20° C.; then washing the filaments with an aqueous liquid; and then drying the filaments under a tension of 0.3 to 1.0 grams per denier; wherein the filaments are dried for 0.4 to 0.9 seconds at a temperature of from 250 to 325° C.

As used herein, poly(paraphenylene terephthalamide) (PPD-T) is the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Additives can be used with the para-aramid in the polymer and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

PPD-T fibers and filaments are generally spun by extrusion of a polymer dope through a spinneret having a plurality of orifices or capillaries into a coagulating bath. The polymer dope is made by forming a solution of the polymer in a solvent. While not restrictive, the preferred solvent for the solution is generally concentrated sulfuric acid. Further, the extrusion is preferably through an air gap into an aqueous coagulating bath. In "air-gap" spinning (also sometimes known as "dry-jet" wet spinning) the spinneret typically extrudes the fiber first into a gas such as air. Some representative processes for forming suitable polymer dopes and spinning the dope through a spinneret are well known and are generally disclosed in U.S. Pat. Nos. 3,063,966; 3,767,756; 3,869,429; 3,869,430; 4,320,081; 4,898,704; & 4,971,539.

The spinning process of FIG. 1 employs what is known as "air-gap" spinning (also sometimes known as "dry-jet" wet spinning). The polymer dope solution 2 is extruded or spun through a die or spinneret 4 to prepare or form the dope filaments 6. The spinneret 4 preferably contains a plurality of orifices (i.e. holes or capillaries). The number of orifices in the spinneret and their arrangement is not critical, but it is desirable to maximize the number for economic reasons. The spinneret 4 can contain as many as 100 or 1000, or more, and they may be arranged in circles, grids, or in any other desired arrangement. The spinneret 4 may be constructed out of any materials that will not be severely degraded by the dope solution 2.

Dope solution 2 exits the spinneret 4 and enters a gap 8 (typically called an "air gap" although it need not contain air) between the face of spinneret 4 and the point that it contacts a coagulation liquid, which can be in the form of a coagulation bath 10 or jets of liquid (not shown), for a very short duration of time. The gap 8 may contain any fluid that does not induce coagulation or react adversely with the dope, such as air, nitrogen, argon, helium, or carbon dioxide. The dope filament 6 proceeds across the air gap 8, and is immediately contacts the coagulation liquid.

Alternately, the fiber may be "wet-spun" (not shown). In wet spinning, the spinneret typically extrudes the fiber directly into the liquid of a coagulation bath and normally the spinneret is immersed or positioned beneath the surface of the coagulation bath. Either spinning process may be used to provide fibers. In some embodiments of the present invention, air-gap spinning is preferred.

The filament 6 is "coagulated" with a coagulation liquid. In the figure the coagulation liquid is in the form of a coagulation bath 10. In some embodiments the coagulation bath contains water or a mixture of water and sulfuric acid. If multiple filaments are extruded simultaneously, they may be combined into a multifilament yarn before, during or after the coagulation step. The term "coagulation" as used herein does not necessarily imply that the dope filament 6 is a flowing liquid and changes into a solid phase. The dope filament 6 can be at a temperature low enough so that it is essentially non-flowing before entering the coagulation bath 10. However, the coagulation bath 10 does ensure or complete the coagulation of the filament, i.e., the conversion of the polymer from a dope solution 2 to a yarn 12 of substantially solid polymer filaments. The amount of solvent, i.e., sulfuric acid, removed during the coagulation step will depend on variables such as the residence time of the filament 6 in the coagulation bath, the temperature of the bath 10, and the concentration of solvent therein.

The inventors have found that the liquid in the aqueous coagulation bath 10 should have a temperature of at least 20° C. It is believed that lower temperatures tend to prematurely fix the polymer chains in the fiber structure, preventing proper crystallization during subsequent drying. It is preferred that the temperature of the aqueous coagulation bath be maintained at 20 to 24° C., with an upper practical temperature being about 30° C. Above this temperature, spinning continuity can be affected.

After the coagulation bath, the yarn 12 may be contacted with one or more washing baths or cabinets 14. Washes may be accomplished by immersing the fiber into a bath, by spraying the fiber with the aqueous solution, or by other suitable means. Washing cabinets can comprise an enclosed cabinet containing one or more rolls that the yarn travels across a number of times prior to exiting the cabinet.

The temperature of the washing fluid(s) is adjusted to provide a balance of washing efficiency and practicality and is greater than about 0° C. and preferably less than about 70° C., and most preferably less than about 30° C. The washing fluid may also be applied in vapor form (steam), but is more conveniently used in liquid form, preferably in the form of an aqueous liquid. Preferably, a number of washing baths or cabinets, such as 16 and/or 18, are used. The duration or residence time for the entire washing of the fiber in the continuous process, using the preferred multiple washing bath(s) and/or cabinet(s), is preferably no greater than about 300 seconds. In some embodiments the duration of the entire washing process is 3 seconds or more; in some embodiments the entire washing is accomplished in 100 seconds or less. In one preferred embodiment, the duration of the entire washing process, through one or more washing baths or cabinets, is 3 to 30 seconds. If desired, for convenience, the filament yarn can be washed under the same tension as the fiber is dried, i.e. 0.3 to 1.0 grams per denier, using individually driven and adjusted/controlled rolls and/or other equipment known in the art that is used to tension threadlines to maintain the tension. In some embodiments, the yarn is washed under a tension of 0.7 to 1.0 grams per denier.

In some embodiments, the washing fluid includes a water soluble base. Useful bases include such things as sodium hydroxide, potassium hydroxide, sodium carbonate, sodium bicarbonate, potassium carbonate, potassium bicarbonate or mixtures thereof.

Before or after washing the fiber with an aqueous base, the process optionally may include the step of washing the yarn with water as a rinse to remove all or substantially all excess base from the yarn. This water wash can be applied in a washing bath or cabinet.

The filament yarn 12, after washing, may be dried in a dryer 20 to remove water and other fluids. One or more dryers may be used. In certain embodiments, the dryer may be an oven which uses heated air to dry the filaments. In other embodiments, heated rolls may be used to heat the filaments. Preferably, the filaments are dried on heated rolls maintained at a temperature of at least 250° C. to 325° C. It is believed that temperatures less than 250° C. will result in inadequately dried yarn, causing yarn property stability issues over time. It is believed that temperatures greater than 325° C. will result in increased yarn stiffness (high modulus, low elongation at break) reducing the suitability of the yarn for most elastomeric end use applications.

The drying time for the filaments, that is, the time the filaments are exposed to this temperature range, is 0.4 to 0.9 seconds. Drying times less than 0.4 seconds are believed to result in inadequate heat transfer to the yarn to provide an adequate crystalline structure to the yarn, meaning reduced yarn strength retention. Drying times in excess of 0.9 seconds are believed to result in too much heat transfer to the yarn, providing an excessive crystalline structure to the yarn and causing increased yarn stiffness (high modulus, low elongation at break). If desired, the dryer can be provided with a nitrogen or other non-reactive atmosphere. The drying step typically is performed at atmospheric pressure. If desired, however, the step may be performed under reduced pressure.

The filament yarn is dried under a tension of 0.3 to 1.0 grams per denier using individually driven and adjusted/controlled rolls and/or other equipment known in the art that is used to tension threadlines to maintain the tension. In some preferred embodiments, the filament yarn is dried under a tension of 0.3 to 0.7 grams per denier. In some preferred embodiments the filament yarn is dried under a tension of 0.3 to 0.5 grams per denier. In some embodiments, the heating utilizes multiple rolls, either in banks of rolls with the yarn contacting the rolls in a serpentine configuration, or in banks of pairs of rolls having multiple advancing wraps. In some preferred embodiments, the filament yarn is dried using a roll configuration that utilizes a serpentine wrap.

Finally, the yarn 12 is wound up into a package on a windup device 24. Rolls, pins, guides, and/or motorized devices 26 are suitably positioned to transport the filament or yarn through the process. Such devices are well known in the art and any suitable device may be utilized.

This invention also relates to the yarn that is wound on the package after drying, which comprises filaments of poly (paraphenylene terephthalamide), the yarn having a tenacity of at least 22 gpd, an elongation at break of at least 3.2 percent, and a tensile modulus of from 530 to 700 gpd. Further, the yarn has a heat-aged strength retention (HASR) of at least 93 percent; and the filaments in the yarn having a D110 crystallinity of at least 55 angstroms. In some embodiments, the yarn has a HASR of at least 95 percent.

In some embodiments, the yarn has a tenacity of at least 24 grams per denier. Preferably, the tenacity of the yarn is from 20 to 28.5 gpd, more preferably 22 to 28.5 gpd, and most preferably 24 to 28.5 gpd.

Preferably yarn has an elongation at break of 3.5 percent or greater. In some embodiments the elongation at break is from 3.2 to 4.2 percent; in some preferred embodiments the elongation at break is from 3.5 to 4.2 percent.

In some embodiments, the yarn has a tensile modulus of less than 650 gpd, and in some preferred embodiments the yarn tensile modulus ranges from 530 gpd to less than 650 gpd.

In some embodiments the yarn is preferably a continuous multifilament yarn having a linear density of 500 to 3000 denier (550 to 3300 dtex). The individual filaments in the yarn can have a linear density of 0.1 to 6.0 denier (0.1 to 6.6 dtex) or higher. Preferably, the individual filaments have a linear density of 0.1 to 2.25 denier (0.1 to 2.5 dtex).

The filaments in the yarn have an apparent crystallite size (ACS) of from 55 to 80 angstroms. In some embodiments, the filaments in the yarn have an ACS of from 55 to 65 angstroms. It is believed that having an apparent crystallite size of less than 55 angstroms will not provide the desired HASR.

ACS is a parameter related to the true crystallite size and shape and crystalline perfection. It is determined by X-ray diffraction analysis, based on wide-angle X-ray equatorial diffraction scans of the fiber. For PPD-T fiber, the equatorial scan gives two sharp diffraction peaks, one at a diffraction angle (2θe) of 20.5° for the (110) plane and one at 23° for the (200) plane. Apparent crystallite size is defined as:

$$ACS=\kappa\lambda/\beta \cos \theta$$

Where κ is taken as 1.0 and λ is the X-ray wavelength (1.5418 Å for Cu κα—In x-ray diffraction the K-alpha line of copper is often used, and the photon produced when a vacancy in this level is filled up has a wavelength of 1.54 Angstrom or 0.154 nm). θ is the Bragg angle, or one-half of the diffraction peak angle. β is the corrected line breadth in radians, as given by $$\beta=(B^2-b^2)^{1/2}$$

where B is the observed line breath in radians and b is the instrumental broadening in radians. Unless designated differently, as used herein, the calculated ACS is determined using the (110) plane diffraction peak.

As used herein, a yarn is a continuous strand of fiber(s), filament(s), or material in a form suitable for knitting, weaving, or otherwise intertwining to form a textile fabric; or in a form suitable for unidirectional and multidirectional fabrics of all types; or in a form suitable as reinforcement for any number of products. Yarns include, for example, (1) a plurality of filaments laid or bundled together without applied or intentional twist, sometimes referred to as a zero-twist yarn or a non-twisted yarn; (2) a plurality of filaments laid or bundled together and are either interlaced, have false-twist, or are bulked or textured in some manner; (3) a plurality of filaments laid or bundled together with a degree of twist, sometimes referred to as a twisted yarn; (4) a single filament with or without twist, sometimes referred to a monofilament or monofilament yarn. In some instances a yarn is called a filament yarn or a multifilament yarn, both of which are generally yarns made from a plurality of filaments. Multiple yarns can be plied or wrapped together to form what is referred to as ply or plied yarns.

This invention further relates to a dipped cord comprising a yarn comprising filaments of poly (paraphenylene terephthalamide) and having a yarn tenacity of at least 22 gpd, an elongation at break of at least 3.2 percent, and a tensile modulus of from 530 to 700 gpd; the yarn having a heat-aged strength retention (HASR) of at least 93 percent; and the filaments in the yarn having a D110 crystallinity of at least 55 angstroms.

The dipped cord utilizes the yarn previously described with all its described crystalline properties. Specifically, however, in some embodiments, the dipped cord utilizes a yarn that has a HASR of at least 95 percent. In some embodiments, the yarn has a tenacity of at least 24 grams per denier. Preferably, the tenacity of the yarn is from 20 to 28.5 gpd, more preferably 22 to 28.5 gpd, and most preferably 24 to 28.5 gpd. Preferably yarn has an elongation at break of 3.5 percent or greater. In some embodiments the elongation at break is from 3.2 to 4.2 percent; in some preferred embodiments the elongation at break is from 3.5 to 4.2 percent. In some embodiments, the dipped cord utilizes a yarn that has a tensile modulus of less than 650 gpd, and in some preferred embodiments the yarn tensile modulus ranges from 530 gpd to less than 650 gpd.

A "cord" is a complete structure made up of a plurality of yarns or plied yarns and, if appropriate, some type of core. The number of individual yarns or individual plied yarns in a cord can range from three to nine or more. In cord construction, the individual yarns or plied yarns and core (if present) are generally have twist; and then those yarns or plied yarns and core (if present) are twisted together to make the cord. As a general rule, the individual yarns or plied yarns when formed are twisted in one direction and, then they are twisted together in the opposite direction to form the cord. When a yarn or cord is viewed from the side, the twist is said to be a "Z" twist if the individual yarn or cord elements appear to go down from right to left. On the other hand, the twist is said to be an "S" twist if the individual yarn or cord elements appear to go down from left to right. A "cord" as used herein is meant to include "hybrid" cord comprising at least two yarns of different composition and "merge" cord comprising two yarns of the same composition.

In some embodiments the cords have a twist multiplier of from 4 to 11 using the cotton count system. Under this system, "twist multiplier" (TM) is defined as:

$$TM=[TPI\times(\text{yarn denier})^{1/2}]/[73]$$

wherein TPI is twists per inch. The number of twists per inch can be determined by observation in plied yarns or cords by counting the number of bumps on the surface of the plied yarn or cord in one inch, and dividing by the number of single yarns plied together to make the plied yarn or cord. Alternatively, another method of determining the number of twists per inch is to measure an inch of yarn and untwist it, counting how many full revolutions it takes until there is no twist left.

A "dipped cord" is a greige or uncoated cord that has been coated with polymeric materials designed to increase adhesion of the cord to matrices such as rubber, as might be encountered in tire construction. In the most usual case, cords are dipped in coating compositions while under some degree of tension and are then dried for further processing. The dipped cord usually has more than one coating of polymeric material and the coatings can be selected from among a wide variety of materials including epoxies, isocyanates, and various resorcinol-formaldehyde latex mixtures and compatible combinations of these materials. Some of the heating steps for drying and/or curing the coating(s) can take place at very high temperatures, therefore the improved HASR of the constituent yarns translates to improved tenacity retention of the greige cord tenacity in the dipped cord. The dipped cords are generally cured again at high temperature when they are incorporated into some other structure such as a rubber tire or fiber-reinforced belting. The percentage retained tenacity of the dipped cords is preferably at least 95%. The percentage retained tenacity is calculated by dividing the dipped cord tenacity by the greige cord tenacity and multiplying by 100. It is believed the improved HASR of the yarns translates into higher tenacity retention of the cured dipped cord.

While the fibers, yarns, and cords described herein are believed to have immediate use in elastomeric and/or rubber articles requiring reinforcement, other uses and applications are possible that utilize fibers, yarns, or cords. These applications include but are not limited to such things as fabrics that are protective and/or resistant to any number or variety of ballistic, dynamic, thermal, or mechanical threats and any number of articles containing the fibers, yarns, cords, and/or articles containing fabrics and/or multilayer structures that contain the fibers, yarns, or cords.

Test Methods

Apparent Crystallite Size (ACS) is calculated using information obtained by wide angle X-ray diffraction as previously described herein. In particular, the method is based on X-ray measurements (equatorial diffractometry scans) and the use of data processing software for peak fitting. The fiber samples to be measured are prepared as follows. Fibers are wrapped on an aluminum holder containing a "zero background" silicon crystal (cut parallel to the 511 planes so that no silicon reflections are observed). The crystal area is 15 mm by 20 mm. The x-ray beam observes, at maximum, a 10 mm by 10 mm region in the center of the crystal. Care is taken to insure that successive wraps are as parallel as possible. Alternatively, if it is not possible to extract sufficiently long pieces of untangled fibers, parallel regions of filaments are cut and taped onto the holder. Equatorial diffractometry data is collected in the symmetrical reflection mode on an automated Philips Norelco diffractometer equipped with a PW1171 automated sample changer, a diffracted beam monochrometer, and using Cu Kα radiation. The data is collected using a scan range of 6° to 35° 2θ, a step size of 0.1° 2θ, and a time of 15 seconds/step. The operating conditions were 40 kV, 40 mA. Lorentz and polarization corrections are then applied. Processing of diffractometry scans is performed using ThermoGalactic GRAMS/AI®, Version 7.00 using Gaussian peak shapes. Using this software, the data format is first converted and then baseline correction and two-stage peak fitting protocol is applied. The Apparent Crystallite Size is then calculated for the 110 reflection.

Heat Aged Strength Retention (HASR) is determined by heating a sample of the yarn or cord for 5 minutes in an oven maintained at 238 degrees Celsius, and then comparing the tenacity of the heated sample ($T_2$) with a sample of the same yarn or cord that has not been heat aged ($T_1$). The HASR is then calculated by use of the equation:

$$HASR=(T_2/T_1)\times 100$$

The mechanical properties of the yarns (tenacity/modulus/elongation) are measured using ASTM D885.

EXAMPLES

In the following examples, poly (p-phenylene terephthalamide) having an inherent viscosity of 6.3 dL/g was dissolved in 100.1% sulfuric acid to yield a 19.4 weight percent spinning solution. After deaeration of spinning dope, dope filaments of the solution at a solution temperature of about 80° C. were air gap spun through a multiple-orifice spinneret and coagulated with a coagulating liquid (water having some residual solvent) to form an as-spun yarn. The as-spun yarn was then forwarded through a water-washing stage, a neutralization stage, and a drying stage, and then was wound up on bobbins. Yarn tensions during washing and neutralization were essentially constant in the range of 0.7 to 1.0 grams per denier. Each Example further specifies the tension on the yarn within the drying stage.

Example 1

Yarns 1a through 1i of various linear densities were made using a coagulation liquid having a temperature of at least 20 degrees Celsius, while varying dryer temperatures and tensions. Processing conditions are shown in Table 1 and yarn properties in Table 2.

Comparison Example A

The general procedure of Example 1 was repeated except the yarn A was made using a coagulation liquid having a temperature of about 3 degrees Celsius. Processing conditions are shown in Table 1 and yarn properties in Table 2.

Comparison Example B

The general procedure as shown in U.S. Pat. No. 7,976,943 was used to make yarn B, using a coagulation liquid having a temperature of about 3 degrees Celsius. Processing conditions are shown in Table 1 and Properties in Table 2.

Comparison Example C

The general procedure as shown in U.S. Pat. Nos. 3,869,429; & 3,869,430 was used to make yarn C, using a coagulation liquid having a temperature of about 3 degrees Celsius. Processing conditions are shown in Table 1 and Properties in Table 2.

TABLE 1

| Example | Coagulation Liquid Temp (° C.) | Dryer Temp, Maximum (° C.) | Dryer Tension g/denier | Drying Time (sec) |
|---|---|---|---|---|
| 1a | 20 | 250 | 1.0 | 0.5 |
| 1b | 20 | 275 | 1.0 | 0.5 |
| 1c | 20 | 300 | 1.0 | 0.5 |
| 1d | 20 | 275 | 0.5 | 0.5 |
| 1e | 20 | 300 | 0.5 | 0.5 |
| 1f | 24 | 275 | 0.5 | 0.5 |
| 1g | 24 | 300 | 0.5 | 0.5 |
| 1h | 20 | 300 | 0.5 | 0.5 |
| 1i | 24 | 300 | 0.5 | 0.5 |
| A | 3 | 250 | 1 | 0.3 |
| B | 3 | 250 | 1 | 0.35 |
| C | 3 | 300 | 2 | 0.3 |

TABLE 2

| Example | Yarn Density | Tenacity g/denier | Elongation (%) | Modulus g/denier | ACS (Å) | HASR (%) |
|---|---|---|---|---|---|---|
| 1a | 1200 | 26.0 | 3.6 | 675 | 56 | 94.9 |
| 1b | 1200 | 25.6 | 3.4 | 707 | 60 | 95.0 |
| 1c | 1200 | 25.2 | 3.3 | 727 | 63 | 96.0 |
| 1d | 1200 | 25.2 | 3.6 | 623 | 59 | 95.7 |
| 1e | 1200 | 24.9 | 3.5 | 638 | 62 | 97.3 |
| 1f | 1200 | 24.9 | 3.7 | 604 | 59 | 95.3 |
| 1g | 1200 | 24.1 | 3.5 | 614 | 67 | 97.8 |
| 1h | 1500 | 25.4 | 3.7 | 614 | 60 | 96.0 |
| 1i | 1500 | 24.9 | 3.7 | 583 | 59 | 96.3 |
| A | 1500 | 22.6 | 3.4 | 599 | 45 | 81.8 |
| B | 1500 | 24.8 | 3.6 | 643 | 45 | 95.9 |
| C | 1420 | 20.0 | 2.4 | 811 | 59 | 100 |

Example 2

Three dipped cords were made from three of the yarns shown in Table 2 of Example 1. Comparison Cord D was made entirely from Yarn A. Inventive Cord 2a was made entirely from Yarn 1h. Inventive Cord 2b was made from Yarn 1i. Each of the greige cords were made by plying three of the 1500 denier yarns together using a twist multiplier of 6 to form a 4500 denier cord. Each of the greige cords was then dipped in an isocyanate-RFL solution and the solution was heat cured onto the cord to make dipped cords. The tenacities of the greige and dipped cords are shown in Table 3, as is the percentage retained tenacity, calculated by dividing the dipped cord tenacity by the greige cord tenacity and multiplying by 100. As shown by the percentage retained tenacity after processing, the improved HASR of the yarns translated into higher tenacity retention of the cured dipped cord.

TABLE 3

| Cord | Greige Cord Tenacity, g/denier | Dipped Cord Tenacity 5% Iso/RFL, g/denier | Retained Tenacity of the Dipped Cord, % |
|---|---|---|---|
| D | 21.4 | 17.8 | 83.3 |
| 2a | 21.7 | 21.4 | 98.7 |
| 2b | 22.4 | 21.6 | 96.3 |

What is claimed is:

1. A yarn comprising filaments of poly (paraphenylene terephthalamide) and having a yarn tenacity of at least 22 gpd, an elongation at break of at least 3.2 percent, and a tensile modulus of from 530 to 700 gpd;

the yarn having a heat-aged strength retention (HASR) of at least 93 percent; and the filaments in the yarn having an apparent crystallite size of from 55 to 80 angstroms.

2. The yarn of claim 1 having a yarn tenacity of at least 24 gpd.

3. The yarn of claim 1 having HASR of at least 95 percent.

4. The yarn of claim 1 wherein the tensile modulus is less than 650 gpd.

5. The yarn of claim 1 wherein the elongation at break is 3.5 percent or greater.

6. The yarn of claim 1 having a linear density of from 500 to 3000 denier.

7. The yarn of claim 1 having a dipped cord strength of greater than 20 gpd.

8. The yarn of claim 1 having a dipped cord percentage tenacity retention of greater than 90 percent.

9. A dipped cord comprising a yarn comprising filaments of poly (paraphenylene terephthalamide) and having a yarn tenacity of at least 22 gpd, an elongation at break of at least 3.2 percent, and a tensile modulus of from 530 to 700 gpd; the yarn having a heat-aged strength retention (HASR) of at least 93 percent; and the filaments in the yarn having an apparent crystallite size of from 55 to 80 angstroms.

10. The dipped cord of claim 9 wherein the yarn has a yarn tenacity of at least 24 gpd.

11. The dipped cord of claim 10 wherein the yarn has HASR of at least 95 percent.

12. The dipped cord of claim 11 wherein the yarn has a tensile modulus that is less than 650 gpd.

13. A process for producing the yarn of claim 1 comprising filaments of poly (paraphenylene terephthalamide), the yarn having a heat-aged strength retention (HASR) of at least 93 percent and the filaments in the yarn having an apparent crystallite size of from 55 to 80 angstroms, comprising the following steps:

i) in a continuous process, spinning a polymer dope through a spinneret having a plurality of orifices and coagulating the dope into a plurality of filaments in an aqueous coagulation bath having a temperature of at least 20° C.;

ii) washing the filaments with an aqueous liquid; and iii) drying the filaments under a tension of 0.3 to 1.0 grams per denier; wherein the filaments are dried for 0.4 to 0.9 seconds at a temperature of from 250 to 325° C.

14. The process of claim 13 wherein the yarn has a HASR of at least 95 percent.

15. The process of claim 13 wherein the tension in step iii) is 0.3 to 0.7 grams per denier.

* * * * *